US006739980B2

(12) United States Patent
Scott et al.

(10) Patent No.: US 6,739,980 B2
(45) Date of Patent: May 25, 2004

(54) GOLF AIMING AND ALIGNMENT SYSTEM AND METHOD

(76) Inventors: Kenneth A. Scott, 10669 E. Acoma Dr., Scottsdale, AZ (US) 85259; Lawrence A. Krause, 10669 E. Acoma Dr., Scottsdale, AZ (US) 85259

( * ) Notice: Subject to any disclaimer, the term of this patent is extended or adjusted under 35 U.S.C. 154(b) by 0 days.

(21) Appl. No.: 10/143,587

(22) Filed: May 10, 2002

(65) Prior Publication Data

US 2003/0013539 A1 Jan. 16, 2003

Related U.S. Application Data

(60) Provisional application No. 60/290,198, filed on May 11, 2001, provisional application No. 60/307,703, filed on Jul. 25, 2001, provisional application No. 60/307,704, filed on Jul. 25, 2001, and provisional application No. 60/307,705, filed on Jul. 25, 2001.

(51) Int. Cl.[7] ..... A63B 69/36; A63B 37/00

(52) U.S. Cl. ..... 473/200; 473/270; 473/205; 473/251; 473/252; 473/280; 473/351; 2/161.2; 36/127

(58) Field of Search ..... 473/200, 251, 473/268, 266, 378, 257, 280, 351, 313, 406, 285, 201, 238, 205, 270, 252; 2/161.2; 36/127

(56) References Cited

U.S. PATENT DOCUMENTS 4,209,172 A * 6/1980 Yamamoto ..... 473/200
4,284,276 A * 8/1981 Worst ..... 473/383
4,441,716 A * 4/1984 Chen ..... 473/237
4,962,931 A * 10/1990 Jazdzyk, Jr. ..... 473/252
D312,858 S * 12/1990 Anderson et al. ..... D21/746
5,356,133 A * 10/1994 Bellagamba ..... 473/406
5,476,258 A * 12/1995 Frisone ..... 473/404
5,529,299 A * 6/1996 Bellagamba ..... 473/285
5,542,680 A * 8/1996 Proudfit et al. ..... 473/378
5,630,763 A * 5/1997 Li-Tsan ..... 473/200
6,386,995 B1 * 5/2002 Jastram ..... 473/406
6,422,949 B1 * 7/2002 Byrne et al. ..... 473/200
6,450,903 B1 * 9/2002 Tate ..... 473/406

* cited by examiner

*Primary Examiner*—Sebastiano Passaniti
(74) *Attorney, Agent, or Firm*—Boyle Fredrickson Newholm Stein & Gratz S.C.

(57) ABSTRACT

A system and method for improving a golfer's putt is provided. Included is a ball, putter, and ball marker, each of which bear directional indicia, such as arrows or triangles. The indicia of the various elements are aligned toward the hole, with the indicia of each element creating a desired directional path. The golfer uses the directional path created by the proper alignment of one or more elements to aim his or her putt. Furthermore, the directional indicia of the golf ball are designed to blend together when the ball is hit in the direction of the indicia, but create a swirl pattern when the ball is mis-hit for visualization of proper and improper putting.

12 Claims, 3 Drawing Sheets

FIG. 7
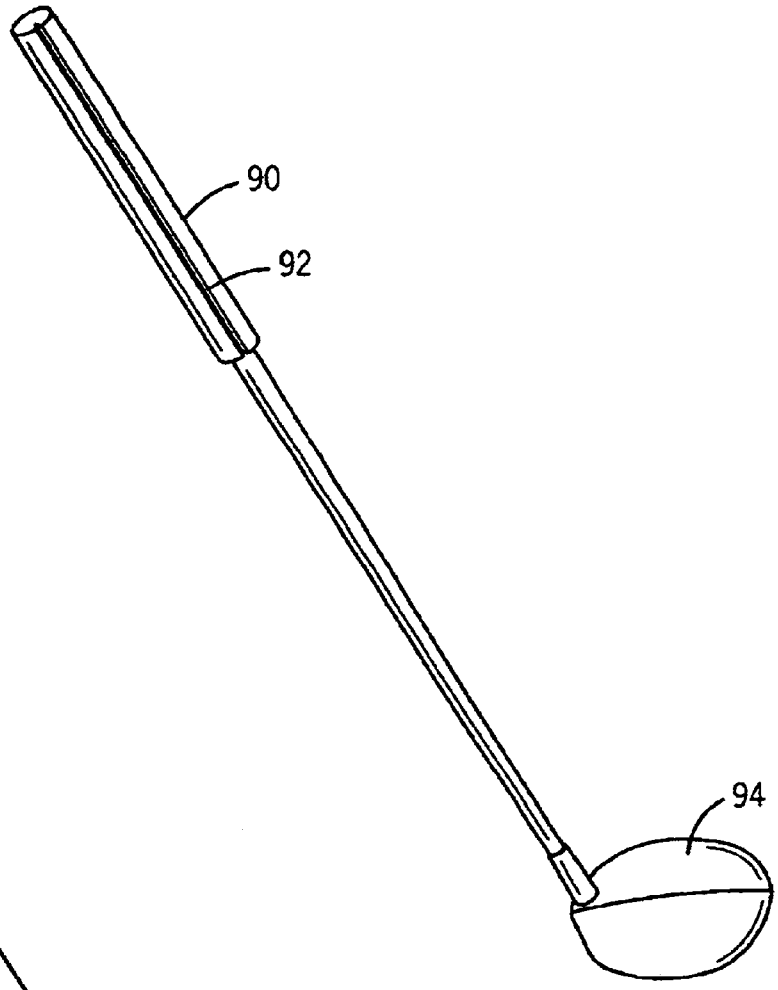
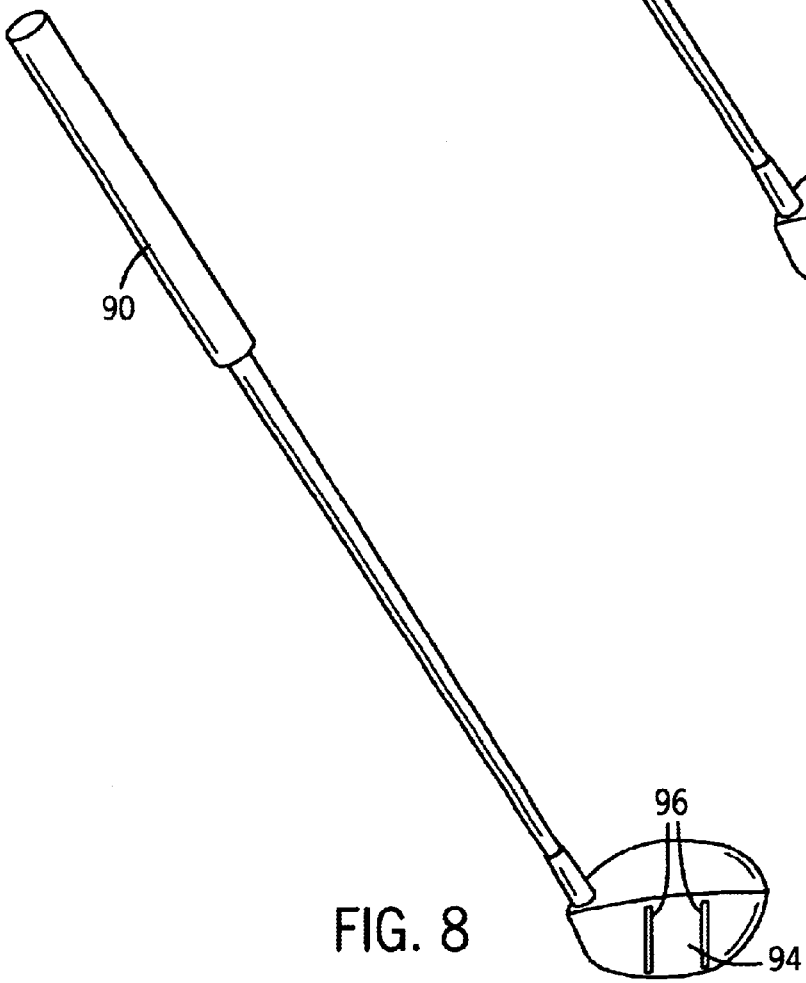
FIG. 8

GOLF AIMING AND ALIGNMENT SYSTEM AND METHOD

CROSS-REFERENCE TO RELATED APPLICATIONS

This application claims the benefit of U.S. Provisional Application Serial No. 60/290,198 filed May 11, 2001; U.S. Provisional Application Serial No. 60/307,703 filed Jul. 25, 2001; U.S. Provisional Application Serial No. 60/307,704 filed Jul. 25, 2001; and U.S. Provisional Application Serial No. 60/307,705 filed Jul. 25, 2001.

FIELD OF THE INVENTION

This invention relates generally to golf, and in particular, to a system and method for improving a golfer's ball, club, and body alignment and thus increase accuracy.

BACKGROUND AND SUMMARY OF THE INVENTION

As is known, proper alignment of golf ball, club, and various other elements involved in golfing are essential to accurate striking of the ball with the club. A golfer who consistently uses proper alignment and squarely addresses the ball increases the accuracy of his or her aim and can thus lower his or her score.

However, the many elements working together in golf, including stance, grip, swing, etc., can produce a situation in which one or more variables negatively impact alignment. A golfer must therefore remember a number of "tricks" for proper alignment of each shot and may easily forget one or more elements. Although the basics of golf are relatively easily learned, it is well-known that becoming proficient at golf is a much more difficult task.

Therefore, it is a primary object and feature of the present invention to provide a system and method for improving alignment in a relatively simple fashion so that both novice golfers who wish to develop proper form, and experienced golfers who need to practice good technique, can be accommodated.

It is a further object and feature of the present invention to provide such a system and method which provides feedback to the golfer, teaching him or her to use proper alignment techniques even when not using the invention.

It is still a further object and feature of the invention to provide separate components of a golf swing training system that can be used together for complete alignment training or can be used separately and in various combinations for addressing particular problem areas, reviewing of certain techniques, or as dictated by personal preference.

It is a still further object and feature of the present invention to provide a system and method for converting existing golf equipment to provide the advantages of the system and method described herein.

Generally, the present invention contemplates a system of golf equipment bearing directional indicia, as well as a method for utilizing golf equipment bearing directional indicia to maximize golfing accuracy.

In accordance one aspect of the present invention, the directional indicia and other features of the golf equipment are designed to create tactile and visual feedback to the golfer so that he or she can learn consistency in proper alignment.

In accordance with another aspect of the invention, each element of the system provides tactile or visual guidance for proper alignment of golf equipment or the golfer's body so that each by itself provides alignment advantages.

In accordance with yet another aspect of the invention, the system and method are not required elements of any equipment but could be provided separately in a kit that allows application and removal of the indicia and other guides from equipment as desired by the golfer.

The present invention contemplates the use of directional indicia, such as arrows, to properly align different golf components, including a golf ball, golf clubs, golf shoes, and golf gloves, in a golf swing training system and method that improves aim and accuracy. Each component of the system is designed to help a golfer visualize and repeat proper alignment, aim, and ball striking. Indicia are placed on select components of the system and are aimed toward the target. The other components of the system are aligned by way of further indicia along the target line. The indicia also encourage square striking of the ball.

For example, directional indicia are applied around the circumference of a standard golf ball. The golfer points the indicia at his or her target, using the indicia to aim toward the target. Another example is that of a putter bearing directional indicia on its head. The golfer uses the line of indicia to align the putter and the ball along the target line in the direction of the hole and uses the indicia. The application and use of directional indicia on other clubs and equipment is similar.

BRIEF DESCRIPTION OF THE DRAWINGS

The drawings furnished herewith illustrate a preferred embodiment of the present invention in which the above advantages and features are clearly disclosed. Other advantages and features will also be apparent from the following detailed description.

In the drawings:

FIG. 7 is a perspective view of a golf club and grip incorporated in the system and method of the present invention; and FIG. 8 is a perspective view of the opposite side of the golf club shown in FIG. 7.

DETAILED DESCRIPTION OF THE INVENTION

The several parts of the system of the present invention give rise to several methods of use in various combinations. For the sake of illustration, the parts have been grouped in combinations according to the preferred embodiments. However, it should be understood that various other combinations of the various parts of the system are contemplated as being within the scope of the present invention.

Sample Combination I: Ball, Putter, and Ball Marker

Figure 1:
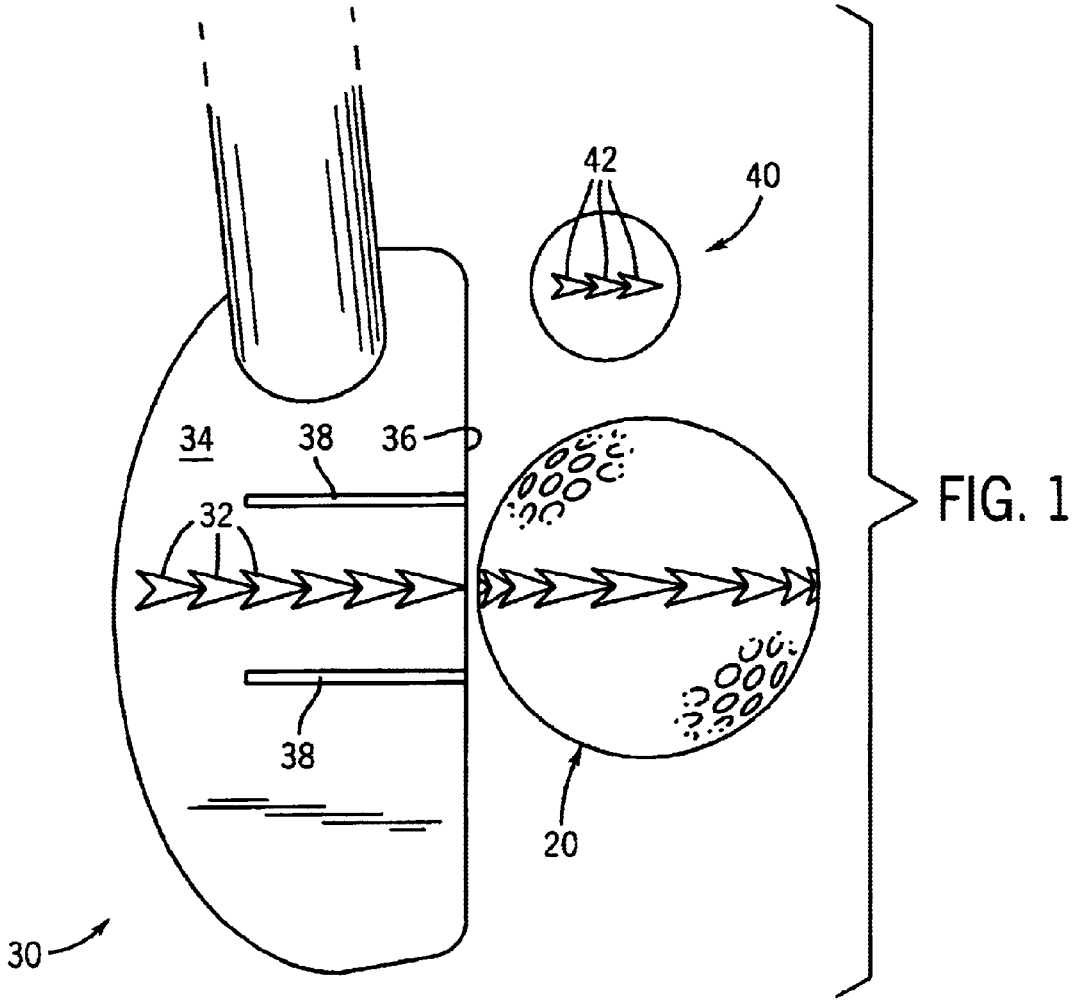
FIG. 1 is a top view of a ball, putter, and ball marker incorporated in the golf swing training system and method of the present invention.

Referring to FIG. 1, a golf ball 20, putter 30, and ball marker 40 are shown. Golf ball 20 bears a pattern of directional indicia 22 laid out in a straight line. Indicia 22 may touch one another, overlap, or be spaced apart from one another, so long as indicia 22 run around the circumference of ball 20.

It is preferred, though not required, that indicia 22 be provided in alternating shades or colors. In this manner, when ball 20 rolls in the direction of indicia 22, the shades or colors blend to create one of a number of optical illusions. The appearance of a solid line can be created when ball 20 is rolling in the proper roll path or, if alternating patterned indicia 22 are used, a unique pattern may emerge. Two or more shades or colors can be used to create a distinct shade or color, different than what is visible when ball 20 is stationary. Alternately, one shade or color can be used for all indicia 22.

For example, indicia 22 may be provided in primary colors yellow and blue, with each indicia 22 in an alternating color. When ball 20 rolls in the direction of indicia 22, indicia 22 will visually blend to create a green line. When ball 20 does not roll in the direction of indicia 22, indicia 22 will not visually combine to form a single line of a third color, but will rather produce a swirl effect in the direction of the misaligned hit. Any combination of shade or colors that would create a first effect while stationary, a second, combined effect while rolling in the direction of the indicia 22, and a third effect while rolling any way but in the direction of the indicia 22 would suffice.

Putter 30 also bears directional indicia 32. In this case, the indicia 32 are located on the head 34 of the putter 30 so they are visible during putting. Indicia 32 are placed so that they point to the proper impact zone on the putter face 36, such as the center of gravity of the putter head 34. Putter 30 also may bear a pair of perpendicular guidelines 38 on the top of putter head 34, each located equidistantly from indicia 32 to highlight a preferred striking zone of putter face 36. The area between guidelines 38 may be colored to further accent the preferred striking zone of face 36 and/or to contrast with indicia 32.

Figure 2:
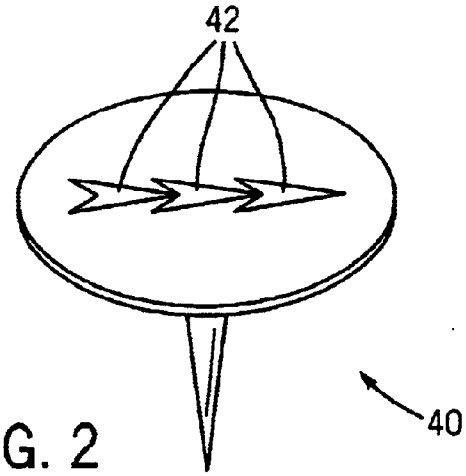
FIG. 2 is a perspective view of the ball marker shown in FIG. 1.

Finally, a ball marker 40 can also be provided with directional indicia 42, as seen in FIGS. 1 and 2. Ball marker 40 may include a stem 44 and a disk-shaped top 46 in a manner as in known, and indicia 42 are applied to the upper surface of top 46. Ball marker 40 can be the approximately the same size as typical ball markers or can be much larger, approaching but preferably not exceeding the diameter of ball 20. In addition, top 46 need not be circular, but may be another geometric or non-geometric shape with one or more directional indicia 42 across its diameter or relative center.

Ball 20, putter 30, and marker 40 are used in a putting method for a golfer who is either practicing putts or is competing in a game of golf. When ball 20 is on the green, the golfer places ball marker 40 behind ball 20 and rotates both ball 20 and ball marker 40 in the direction of the intended roll path using indicia 22 and 42 as guidelines. While ball marker 40 and its indicia 42 extend the directional line formed by indicia 22 of ball 20, increasing a golfer's ability to establish the desired roll path, the golfer may choose to use only the indicia 22 of ball 20 for aiming.

After removing ball marker 40 from the putting surface, the golfer positions putter 30 so that its indicia 32 are in alignment with indicia 22 of ball 20. The golfer then swings putter 30 along the directional line of indicia 22 and 32, also using guidelines 38 to properly align putter 30 and ball 20 in the direction of the hole. Proper contact is achieved when putter face 36 makes contact with ball 20 at the point where indicia 22 and 32 meet.

The golfer then receives feedback from ball 20 as to the accuracy of the putt by watching indicia 22. When indicia 22 create a solid line or pattern, and/or a distinct color or shade is created, the golfer knows that ball 20 is rolling in the direction of the indicia 22 as desired. An improper strike of ball 20 will create a swirl effect around ball 20 reflecting the direction of the mis-hit of ball 20. In addition, while the advantages of multi-colored indicia 22 on ball 20 have been described for putting, the same advantages apply at the tee and on the fairway for aiming properly and aligning to the target line since proper aim and alignment is equally important in those situations.

Ball 20, putter 30, and ball marker 40 can each be used independently of each other by the golfer for the alignment benefits of each individual component, can be used in any combination with each other, or can be used as described, as a total putting alignment and feedback system. For instance, while a golfer might use only ball 20, only putter 30, or only ball 20 and putter 30 while playing a regulation game of golf, a golfer may wish to use only putter 30 and marker 40 to practice proper alignment and technique in his or her home, office, or other location.

Sample Combination II: Clubs Shoes, and Glove

Figure 3:
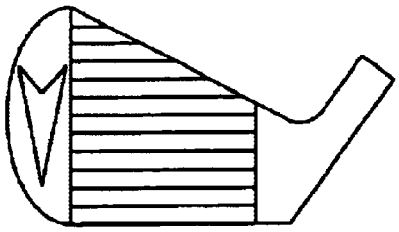
FIG. 3 is front view of a golf club, in the form of an iron, incorporated in the system and method of the present invention.
Figure 4:
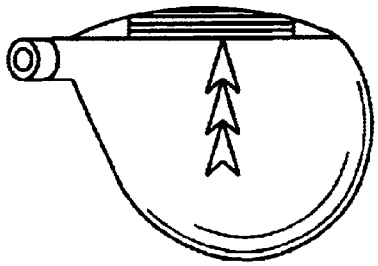
FIG. 4 is a top plan view of a golf club, in the form of a wood, incorporated in the system and method of the present invention.

As seen in FIGS. 3 and 4, an iron 50 and/or a wood 60 can be adapted for use with the system and method of the present invention for proper alignment of the iron 50 or wood 60 at address. In FIG. 3, iron 50 bears an indicator arrow 52 or other indicia at its toe 54 or at another location on its top or its face 56. When iron 50 is positioned adjacent ball 20 so that iron face 56 is squarely behind ball 20 at address, arrow 52 points downward toward the desired target of the shot.

As seen in FIG. 4, a wood 60 can also be equipped with indicia 62 such as a single arrow or a series of arrows. The indicia 62 are positioned over the center of gravity of the wood 60, or any other preferred striking point of the wood face 64.

Figure 5:
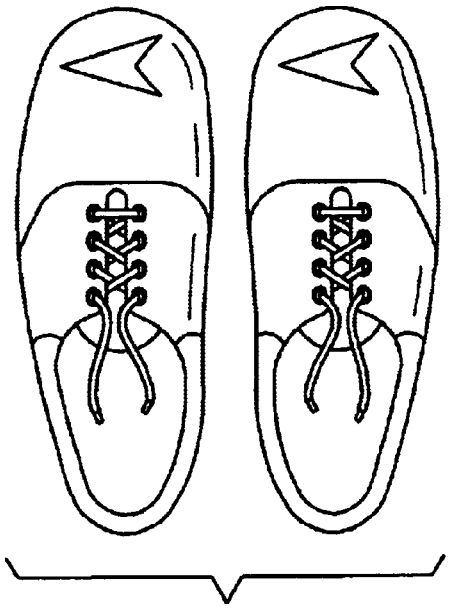
FIG. 5 is a top view of a pair of golf shoes incorporated in the system and method of the present invention.

FIG. 5 shows golf shoes 70 also bearing directional indicia 72 for proper placement of the feet during address of ball 20 for a square strike. Indicia 72 are located at the toes of shoes 70 and indicia 72 point to the wearer's left in the case of a right-handed golfer or to the right in the case of a left-handed golfer. Alternatively, a single indicium 72 could be placed on either the right or left shoe 70 according to the interests of the golfer or manufacturer.

Figure 6:
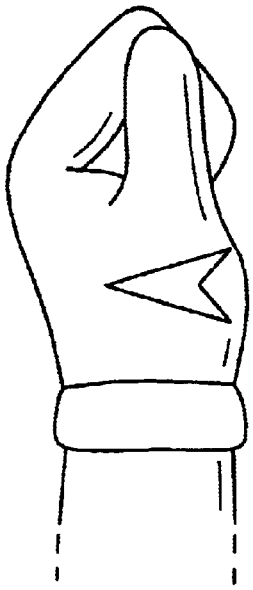
FIG. 6 is a perspective view of a golf glove incorporated in the system and method of the present invention.

FIG. 6 illustrates a golf glove 80 also bearing directional indicia 82. Each indicium 82 is located below the base of the thumb 84 of the golf glove, pointing to the wearer's left in the case of a right-handed golfer or, in the case of a left-handed golfers, indicium 82 points to the wearer's right.

In use, the combination of iron 50 or wood 60 along with shoes 70 and glove 80 provides a golfer with several means of adjusting his or her address of ball 20 to properly align his or her shot. First, if the golfer uses ball 20 having indicia 22 on the tee or fairway, he or she may place ball 20 with indicia 22 indicating the desired line of the shot. At address, the golfer can align indicia 52 or 62 of the iron 50 or wood 60 either with indicia 22 of ball 20, or in relation to the desired target, or both. In any case, when club face 56 or 64 is properly aligned, indicia 52 and 62 should be aligned with indicia 22 of ball 20 as well as with the desired target.

The golfer's proper stance includes alignment of his or her feet (not shown) so they are positioned in what is known as "railroad track" alignment. The desired target and the ball form the two ends of a first "track". The golfer stands on a second "track", with his or her feet parallel to one another. This visual aid for proper stance is easier to imagine and thus obtain with the use of golf shoes 70 bearing indicia 72. After the golfer aligns the ball 20 and club with the desired target as described above, he or she creates the second "track" using indicia 72. Indicia 72 allow a golfer to readily visualize the extending lines, or tracks, and thus makes it easier for him or her to obtain a recommended form when addressing the ball 20.

In addition, advanced golfers who can "work the ball" or hit the ball in such a way to effect its flight path, direction, and result, also benefit from the use of shoes 70. A golfer who advances his or her front foot closer to the ball at address can affect the resulting flight path so that the ball will have a right-to-left flight path, while moving the lead foot away from the ball produces an opposite, left-to-right flight path. The degree of movement is determined by the distance the lead foot is advanced toward or away from the ball. Inidica 72 are helpful to a more advanced golfer by allowing him or her to gauge the position of his or her feet relative to each other and to the ball, thus providing the golfer feedback as to precise foot positioning and the ability to repeat effective positions to achieve more consistent results.

Finally, the golfer's hand position is also finalized at address. Golf glove 80 bears indicia 82 that can be used to ensure square alignment of all elements, including the hands, in addressing ball 20. The location of indicia 82 at address shows proper shoulder alignment so that the golfer's upper body is square with his or her properly aligned lower body. When all the indicia being used in the system are aligned at address, the golfer is properly aligned, and the golf shot is properly aimed.

After properly addressing the ball, the golfer can further utilize the present alignment system and method to establish a straight swing line for his or her back swing and can attempt to replicate the swing line in his or her follow-through, thus actually contacting the ball at its proper position, with the desired portion of the club, with (theoretically) the effect of driving the ball straight in the desired direction.

Sample Combination III: Club and Grip

As seen in FIG. 7, another element of the system and method of the present invention is a golf club grip 90 that includes a sensory strip 92. Strip 92 is positioned on grip 90 opposite the club face 94. In a preferred embodiment, strip 92 may be 2mm thick by 4 mm wide and constructed of stainless steel. It is placed or molded inside and running down the length of grip 90 so that strip 92 can be felt through grip 90. Strip 92 can also be made of another material or in other dimensions, or can be molded as a notch in grip 90. Marks or indicia (not shown) can be provided on grip 90 to indicate the location of strip 92.

The rules of golf allow for a rib or bar to be placed under the grip of a golf club. However, these devices are traditionally placed at the 6 o'clock position when mounted rather than opposite the club face 94 at the 3 o'clock position.

At address, when club face 94 is held square and flush to ball 20, sensory strip 92 can be felt in the golfer's hand, adding his or her tactile senses to the visual senses that are so important in golf. Strip 92 gives golfers the ability to properly position and angle the club face 94 at address and create a tactile impression of proper positioning. Golfers can therefore learn to "feel" proper positioning and alignment using grip 90 and strip 92 and can train themselves to recreate the sensation established at address at the point of impact in the golf swing. The addition of a tactile feedback of proper positioning leads overall to a golfer's ability to more consistently strike the ball squarely.

Finally, as seen in FIG. 8, indicia 96 are added to club face 94 to provide yet another visual guide for square address and thus square striking. Indicia 96 may or may not be directional such as arrows or triangles, but are designed to be highly visible to a golfer, such as in bright or highly contrasting colors. Indicia 96 are preferably positioned to indicate the preferred striking zone for ball 20 when club face 94 is properly positioned behind ball 20, and indicia 96 are thus the approximate width of a golf ball. Additional indicia may indicate the entire preferred striking zone of the club face or the target line. At address, indicia 96 assist the golfer in placing the club face in a square position behind the ball in relation to the desired target line.

On drivers and fairway woods, the club face indicia 96 are replaced by a similar alignment and sighting pattern on top of the club head (not shown) indicating the preferred striking zone, because with these clubs, the club face is not seen at address.

Each of the sample combinations described above could be combined with each of the other sample combinations or subcombinations, as desired by the golfer. Likewise, individual elements of each sample combination could be used in various combinations with other individual elements to form other useful combinations.

In each of the combinations described, at least some components bear directional or "pointing" indicia. Arrowheads or triangles are preferred indicia, as these clearly "point" in a particular direction when laid end to end, but any shape will suffice. It is also possible to use a corporate logo, text, or another geometric or non-geometric shape or design rather than "pointing" type directional indicia, as shown in the accompanying drawings. In a preferred form, the indicia are laid out along a line and are visible as separate elements while the pattern is stationary. Alternatively, the indicia may be in the form of a line applied to a component, or spaced apart elements of any shape applied to a component of the system in a linear orientation.

The indicia of the various components can be of the same general shape and/or color scheme throughout so that the system can be recognized as a series of integrated tools, or each component can use similar or different indicia as desired by the golfer or manufacturer. Whatever the shape chosen, indicia may be applied to the component in any suitable manner. For example, engraving or printing indicia might be most appropriate for a putter or iron, while for a wood, engraving or adhering might be best. Gloves and shoes may utilize an iron-on patch or embroidered indicia, while a kit of indicia for customizing pre-purchased equipment may include various suitable pressure-applied materials.

Furthermore, the invention is not limited to the components and methods described above. It is envisioned that other indicia-bearing components, including but not limited to a putting mat and putting cup could be added to the system. It is also envisioned that a variety of training methods could be devised using the various components alone and in combination. The above description is therefore made by way of illustration rather than limitation, and other ways of carrying out the invention are contemplated as being within the scope of the following claims, which particularly point out and distinctly claim the subject matter regarded as the invention.

We claim:

1. A golf swing training system comprising:

a spherical golf ball having an equator and an outer surfaces;

a golf club having a surface;

a first set of circumferentially spaced directional indicia extending about the entire outer surface of the golf ball along the equator; and a second set of linearly spaced directional indicia extending in a single direction along the surface of the golf club;

wherein the directional indicia on the golf ball and the directional indicia on the surface of the golf club are configured to form a generally linear visual representation of the direction of a golf swing for striking the golf ball with the golf club.

2. The system of claim 1, further comprising a ball marker having directional indicia.

3. The system of claim 1, wherein the directional indicia on the golf ball visually blend to create the illusion of a contiguous line when the golf ball rolls in the direction of the indicia.

4. The system of claim 3, wherein the directional indicia on the golf ball are of at least two different colors.

5. The system of claim 3, wherein the directional indicia on the golf ball are of a single color.

6. The system of claim 4, wherein the colors of the golf ball indicia visually blend when the golf ball rolls in the direction of the indicia.

7. The system of claim 1, wherein the indicia on the golf ball are arrowheads.

8. The system of claim 1, further comprising:

a first ball alignment strip extending along the surface of the golf club on a first side of the second set of directional indicia; and a second ball alignment strip extending along the surface of the golf club on a second side of the second set of directional indicia;

wherein the first and second ball alignment strips are generally parallel to equal each other and to an axis along which the second set of directional indicia extends.

9. The system of claim 8, wherein the first ball alignment strip and the second ball alignment strip are equidistant from the second set of directional indicia.

10. The system of claim 8, wherein the golf ball has a diameter and wherein the first ball alignment strip is spaced from the second ball alignment strip by a distance generally equal to the diameter of the golf ball.

11. The system of claim 1, further comprising a golf glove having hand alignment indicia affixed thereto and being receivable on a hand of a golfer, the hand alignment indicia being alignable with the first and second sets of directional indicia as the golfer positions the golf club behind the golf ball.

12. The system of claim 1, further comprising:

a pair of golf shoes having a toe end, a heel end, and an upper surface; and foot alignment indicia affixed to the upper surface of each shoe adjacent the toe ends, the foot alignment indicia facilitating alignment of a golfer's feet when addressing the golf ball with the golf club.

* * * * *